US005732638A

United States Patent [19]

Van Lint

[11] Patent Number: 5,732,638

[45] Date of Patent: Mar. 31, 1998

[54] DEVICE FOR BANK NOTE CONTAINERS

[75] Inventor: Greg Van Lint, Hoegarden, Belgium

[73] Assignee: Imperial Chemical Industries PLC, United Kingdom

[21] Appl. No.: 771,362

[22] Filed: Dec. 16, 1996

Related U.S. Application Data

[63] Continuation of Ser. No. 237,283, May 3, 1994.

[30] Foreign Application Priority Data

May 5, 1993 [GB] United Kingdom ..... 9309183

[51] Int. Cl.[6] ..... E05G 1/00

[52] U.S. Cl. ..... 109/29; 109/33; 109/36; 109/75

[58] Field of Search ..... 109/1 R, 2, 29, 109/31–37, 20, 21, 75

[56] References Cited

U.S. PATENT DOCUMENTS

| | | | |
|---|---|---|---|
| 3,344,757 | 10/1967 | Touyet | 109/29 X |
| 3,915,103 | 10/1975 | Rupert et al. | 109/2 |
| 3,945,329 | 3/1976 | Bywater | 109/75 X |
| 4,363,279 | 12/1982 | Johansson | 109/20 X |
| 4,391,203 | 7/1983 | Millar | 109/29 X |
| 4,712,489 | 12/1987 | Levavasseur | 109/20 X |
| 4,722,435 | 2/1988 | Mareels et al. | 109/33 X |
| 4,799,435 | 1/1989 | Boutroy | 109/20 X |
| 5,156,272 | 10/1992 | Bouchard | 109/29 X |
| 5,406,896 | 4/1995 | Jacobson | 109/29 |
| 5,410,295 | 4/1995 | Van Lint | 340/568 |

FOREIGN PATENT DOCUMENTS

| | | | |
|---|---|---|---|
| 2445429 | 8/1980 | France | 109/29 |
| 9117681 | 11/1991 | WIPO | 109/36 |

*Primary Examiner*—Suzanne Dino

[57] ABSTRACT

A device for use in a bank note container such as a preloaded cassette used in cash dispensers having the purpose of rendering unusable the bank notes in the container in the case there is detected (preferably by electronic means) a violation, attempted theft or unauthorized manuever to displace or remove the container.

8 Claims, 2 Drawing Sheets

DEVICE FOR BANK NOTE CONTAINERS

This is a continuation of application Ser. No. 08/237,283 filed on May 3, 1994.

TECHNICAL FIELD

The present invention is directed to a new device to be adapted in a bank note container such as a preloaded cassette used in cash dispensers.

The purpose of the device is to render unusable the bank notes in the container in the case there is detected a violation, attempted theft or unauthorised maneuver to displace or remove the container. This is detected preferably by a suitable electronic means.

RELATED APPLICATION

The present invention may employ a colored ink composition claimed in a contemporaneously filed application Ser. No. 08/237,282, and the contents thereof are incorporated herein by reference.

BACKGROUND OF THE INVENTION

In the case of containers for transportation, for example suitcases, it is well known to include devices that will, in the case of theft or aggression, invalidate the bank notes which are contained therein. This is achieved by automatically spraying a colored liquid, for example as a consequence of a controlled explosion. The ink will preferably be indelible.

For this purpose, several systems are known. Among them, a device is known which includes a cylinder containing the ink and a piston that will be actuated, in the case of theft, via electronic or mechanical means and possibly a $C0_2$ cartridge or canister.

Another device comprises an ink reservoir and a $CO_2$ cartridge which once actuated will eject the ink mixed with the gas in the container. In the latter case, a substantial portion of the ink is not delivered onto the stacks of bank notes.

These devices are complicated and not very reliable due to the presence of mechanical parts and the possibility of blockage.

The present invention is to overcome these problems, and is directed towards providing a new device for staining, preferably permanently, the bank notes in a container, such container being preferably for use in an automatic cash dispenser.

SUMMARY OF THE INVENTION

The device according to the invention is preferably adapted for being a part of a preloaded bank note cassette. Such a cassette is generally elongated and contains a stack of bank notes which may be individually delivered through a suitable mechanism. The cassette may only be opened by authorised operators, the cover being removable or hinged to a side wall thereof.

The invention provides a device adapted to be incorporated in a bank note container comprising:

- an ink reservoir having rigid walls for containing a liquid coloring material
- a removable gas reservoir containing a pressurized gas
- adjacent thereof, an actuator connected to a detection system, in order to liberate the pressurized gas from said gas reservoir if required by said detection system
- ink discharging means connected to the ink reservoir via a retaining valve wherein the ink reservoir comprises an elastic sealing membrane extending substantially on one side and delimiting a second compartment that, in operation, may be inflated by the pressurized gas liberated from the gas reservoir.

DESCRIPTION OF THE DRAWINGS

The invention will be more clearly understood from the following description of some preferred embodiments thereof, given by way of example and with reference to the drawings wherein.

Figure 1:
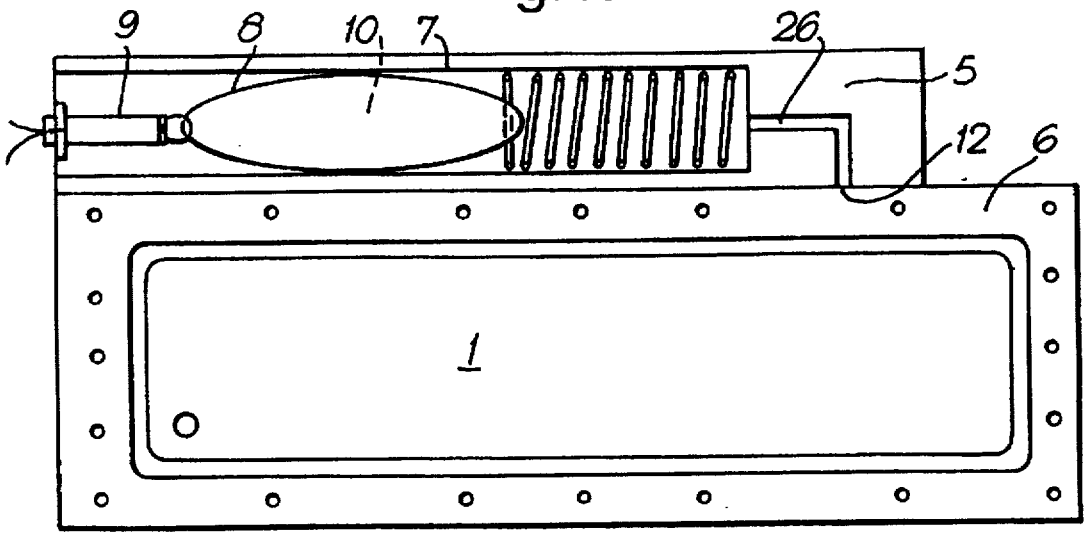
FIG. 1 is a top view, partially sectional, of the device, the cover of the reservoir being removed.
Figure 2:
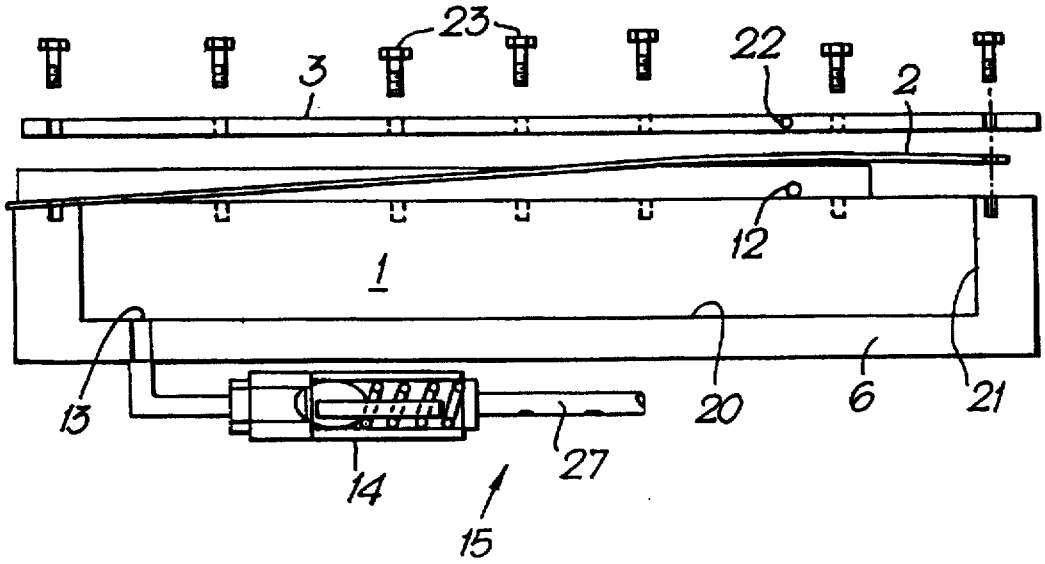
FIG. 2 is a side elevation view of the device.

According to one embodiment of the invention, as illustrated in FIGS. 1 and 2, such a device comprises an ink reservoir or first empty compartment 1 for liquid colored ink, one of the walls of the ink reservoir being entirely covered by a flexilble and extendible membrane 2, said membrane fixed to the adjacent rigid walls of the reservoir. The external side of the membrane 2 may be in close contact with a covering plate 3 which preferably comprises internal groove(s) 4, defining a second empty compartment. The membrane, comprising an elastomer or rubber material, acts as a sealing membrane between both compartments.

A second element 5 of the device, adjacent to a reservoir body 6, contains an elongated removable gas reservoir 7, connected to the second empty compartment. Said gas reservoir 7, which is located in a separate compartment adjacent to the ink reservoir 1, contains a pressurized gas cartridge or equivalent means 8, together with an actuator 9, screwed to the body of the element 5, able to liberate the pressurized gas 10, for example by way of a controlled explosion in order to break the head of the cartridge 8. Electronic means 11 provides the suitable signal or detection system when such action is required.

The removable gas reservoir 7 is connected through a pipe or an internal bore 26 to an outlet 12 directed, directly or indirectly, to the first empty compartment or ink reservoir 1.

The body of the removable gas reservoir 7 will preferably be integral with the body of the ink reservoir 1.

The outlet 13 of the ink reservoir 1 is connected to a retaining or ball valve 14 and an ink distributing or discharging means 15, such as a pipe 27 perforated on its entire length or nozzles directed, when adapted to a bank notes cassette 28, towards the stack of bank notes 29. Such means will extend along at least one side of the container, preferably along the cover 25 thereof, as illustrated in FIG. 4.

Figure 4:
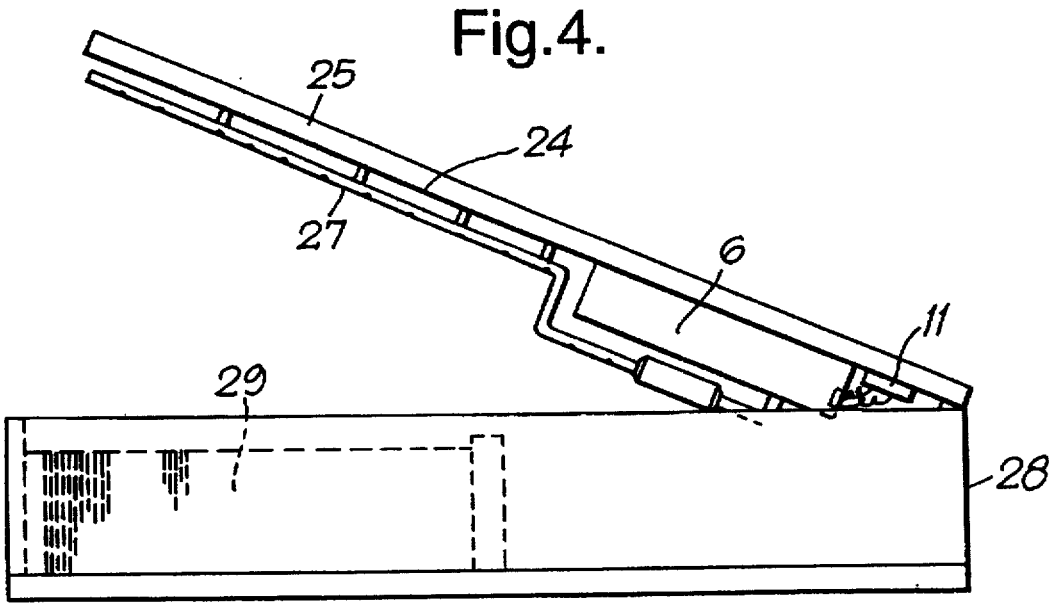
FIG. 4 illustrates schematically a bank notes cassette with the device according to the invention.

When actuated by the electronic detection system, a gas such as CO2 under pressure will be distributed, by way of said electronic means 11 and said outlet 12, on one side of the membrane 2 and push said membrane which, being extendible, will inflate and extend against the opposite 20 and side walls 21 of the ink reservoir 1, pushing said ink through the retaining valve 14 in the distributing means 15, for example, a perforated pipe 27 located above the stack of bank notes 29, as shown in FIG. 4, and then on and into the bank note stack or stacks of the cassette 28.

Figure 3:
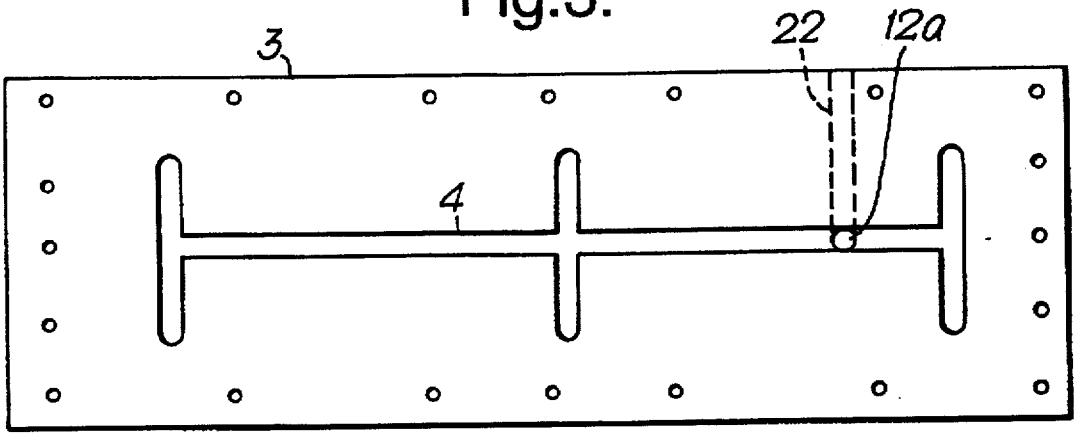
FIG. 3 is a top view of the covering plate.

According to a particular embodiment as illustrated in FIG. 3, the rigid plate 3 is provided with an internal conduit 22 with an outlet 12*a* in the middle of the internal side, said conduit being adapted to match the outlet 12 of the element 5 containing the actuator 9 and the cartridge 8.

As mentioned, preferably the upper cover or plate 3 is provided with interconnected grooves 4 on its internal face in order to facilitate the $CO_2$ distribution on the entire surface of the membrane 2. The cover 3 is firmly positioned by screws or bolts 23, as shown in FIG. 2 and will preferably compress the lateral sides of the membrane 2 against the upper parts of the side walls 21 of the ink reservoir 1.

The device and covering plate 3 may be of metal or rigid plastic material.

The retaining valve 14 located between the ink reservoir 1 and the pipe 27 will allow passage of the ink, for example only at pressure above 1 kg. Typically the pressure in the $CO_2$ compartment of the reservoir, immediately following the actuation, will be 5 kg and more than 90% of the ink will be ejected from the ink reservoir 1 through the discharging means 15.

The above retaining valve 14 may be a ball-spring type one way valve.

According to one embodiment of the invention, as illustrated in FIG. 4, the device, including the valve and the perforated pipe 27, is fixed by conventional means to the internal side 24 of the upper cover 25 which is hinged to the body of a cassette 28. The cassette 28 is adapted to contain a stack of bank notes 29 for a cash dispenser. The electronic means 11 and a power supply (battery) which are a part of the detection system are preferably adjacent to the body of the device.

The device according to the invention may be incorporated in valuable containers other than bank note dispensers, for example in safes, suitcases or within security vans.

I claim:

1. A device adapted to be incorporated in a bank note container comprising:

an ink reservoir having rigid walls for containing a liquid coloring material, a removable gas reservoir containing a pressurized gas, and adjacent thereof, an actuator connected to a detection system, in order to liberate the pressurized gas from said removable gas reservoir if required by said detection system, ink discharging means connected to the ink reservoir by way of a retaining valve, wherein, one of the walls of the ink reservoir is covered by an elastic sealing membrane which, in response to said detection system, is inflated by the pressurized gas liberated from the removable gas reservoir, and said sealing membrane covers a rigid plate comprising a plurality of inside grooves, and is fixed to the rigid walls of the ink reservior.

2. The device claimed in claim 1 wherein the removable gas reservior is located adjacent to the ink reservior and connected therewith through a pipe or a hole.

3. The device claimed in claim 2 wherein the discharging means is an elongated perforated pipe.

4. The device claimed in claim 1 which further comprises a bank note container, which is a preloaded bank note cassette for a bank note dispenser.

5. The device claimed in claim 1 wherein the membrane is made of an elastomer.

6. The device claimed in claim 5 wherein the membrane is made of rubber.

7. The device claimed in claim 1 wherein the retaining valve is a ball valve.

8. The device claimed in claim 1 wherein the detection system is an electronic detection system.

* * * * *